US011719511B2

(12) United States Patent
Barrett et al.

(10) Patent No.: US 11,719,511 B2
(45) Date of Patent: Aug. 8, 2023

(54) APPARATUS AND METHODS FOR DETECTION OF A SHOT FIRING EVENT

(71) Applicant: InVeris Training Solutions, Inc., Suwanee, GA (US)

(72) Inventors: Dave Barrett, Alpharetta, GA (US); Wen Li, Alpharetta, GA (US); Carter Crittenden Bennett, Buford, GA (US); Scott Billington, Suwanee, GA (US); Steven Fred Hering, Lawrenceville, GA (US)

(73) Assignee: InVeris Training Solutions, Inc., Suwanee, GA (US)

( * ) Notice: Subject to any disclaimer, the term of this patent is extended or adjusted under 35 U.S.C. 154(b) by 925 days.

(21) Appl. No.: 15/928,031

(22) Filed: Mar. 21, 2018

(65) Prior Publication Data

US 2019/0293388 A1 Sep. 26, 2019

(51) Int. Cl.
*F41G 3/26* (2006.01)
*F41A 33/02* (2006.01)

(52) U.S. Cl.
CPC ..... *F41G 3/2655* (2013.01); *F41A 33/02* (2013.01)

(58) Field of Classification Search
CPC ..... F41G 3/26; F41G 3/2655; F41A 33/00; F41A 33/02; F41A 33/04; F41A 33/06
See application file for complete search history.

(56) References Cited

U.S. PATENT DOCUMENTS

| | | | | |
|---|---|---|---|---|
| 4,234,911 | A | 11/1980 | Faith | |
| 6,314,671 | B1 | 11/2001 | Gering | |
| 8,414,298 | B2 | 4/2013 | D'Souza et al. | |
| 9,019,366 | B2 | 4/2015 | Goldberg et al. | |
| 9,366,493 | B2 | 6/2016 | Lupher | |
| 10,663,259 | B2 * | 5/2020 | Allgaier | F41G 3/26 |
| 2003/0136900 | A1 | 7/2003 | Schecter et al. | |
| 2007/0190495 | A1 * | 8/2007 | Kendir | F41A 33/02 434/21 |
| 2010/0014010 | A1 * | 1/2010 | He | C09K 19/60 349/13 |
| 2010/0233660 | A1 | 9/2010 | Skala et al. | |
| 2013/0071815 | A1 | 3/2013 | Hudson et al. | |
| 2018/0252491 | A1 * | 9/2018 | Son | F41G 3/2605 |

FOREIGN PATENT DOCUMENTS

WO 2005-045573 A2 5/2005

OTHER PUBLICATIONS

International Searching Authority, Notification of Transmittal Of The International Search Report And The Written Opinion of the International Searching Authority Or The Declaration, (PCT Rule 44.1); dated Jun. 27, 2019, pp. 1-8; International application No. PCT/US2019/022797, International Filing Date: Mar. 18, 2019; Applicant, Meggitt Training Systems, Inc.

* cited by examiner

*Primary Examiner* — Timothy A Musselman
(74) *Attorney, Agent, or Firm* — Orbit IP, LLP

(57) ABSTRACT

A method of determining an aim point of a firearm or simulated firearm at a time of firing by continuously pulsing a laser coaxially aligned with a barrel of the firearm or simulated firearm. The aim point is then continuously detected by a camera system observing the target. A shot firing event is detected and the last detected laser pulse location on the target prior to the shot firing event is determined. The aim point of the firearm or simulated firearm at the time of firing is extrapolated from the last detected laser pulse location and at least one laser pulse location prior to the last laser pulse location.

20 Claims, 4 Drawing Sheets

APPARATUS AND METHODS FOR DETECTION OF A SHOT FIRING EVENT

FIELD

The present patent document relates generally to weapons training and weapons training systems. More specifically, the present patent document relates to devices and methods for detection of a shot firing event for use in weapon simulation systems. Several methods have been developed that all improve the state of the art.

BACKGROUND

In most weapon training systems that try and detect aim point, the speed at which the firing event can be detected is critically important, because when the bullet starts to move, the weapon recoils and changes the aim point. Accordingly, the faster you can detect the shot firing event, the more accurately you can detect the aim point.

In a typical firing event, the shooter pulls the trigger and breaks the sear holding back a spring-loaded firing pin. The time for the unconstrained firing pin to strike the back of the cartridge case is called "lock time". The lock time is on the order of 2-20 milliseconds depending on the design of the firearm, etc. Next, the powder in the cartridge case is ignited by the detonation of the primer in the cartridge case. The bullet will exit the barrel in about 1 msec for a pistol and about 3 msec for a rifle. This is the time that a bullet takes to accelerate down the barrel and exit. For a pistol, the bullet only accelerates to ~1100 feet/second, but only has a barrel that is about 6" long. For a rifle, the bullet can accelerate to ~3000 feet/second, but has a barrel that can be 26" long. The important thing to take from this is that once the primer strikes, the bullet has effectively left the gun. The gases pushing the bullet out of the barrel also produce a reaction force pushing against the back of the gun. This reaction is known as recoil. In the brief instant of firing, the mass of the gun is accelerated with this recoil impulse and starts moving. This recoil or kickback is reacted by the human body over 10s of milliseconds, depending on the shooter. In this time, the aim point is disturbed significantly. However, the bullet has exited the barrel long before any appreciable motion happens. In essence, the bullet will go where the gun was aimed prior to the shot, because there is so little time for recoil to move the gun before the bullet exits.

From a sensing perspective, the most commonly used sensor to measure firing events is an accelerometer. In current systems, when the accelerometer senses the shot firing event, a laser mounted on the firearm and bore sighted with the barrel is pulsed. When the recoil from either a live round or even a simulated pneumatic system occurs, the gun has to move above a pre-set acceleration threshold for the firing event to be sensed and a laser pulse to be fired. By definition, the gun had to have moved for this to register. Consequently, the laser pulse fires and is recorded when the gun is pointing in a different place than where the actual shot was fired.

In simulation systems that use mechanically actuated systems, no bullet exits. The forces all must be reacted internally. Therefore, when the firing pin strike opens a pneumatic valve that ultimately actuates the bolt—it is very common for the recorded shot location to be below the actual aim point. As the top of the gun pushes rearward, the front of the gun pushes down.

Accordingly, it would be advantageous if a method and system was developed that could more accurately detect an aim point of a shooter.

There are numerous kits on the market to retrofit a real firearm for use in weapons training. These kits include a variety of technologies that allow weapons training systems to evaluate a trainee's use of his/her firearm. For example, these kits may include a laser mounted coaxial with the firearm barrel to allow the weapon system to determine an aim and hit point. The kits may involve systems for simulating recoil. One such system for simulating recoil is disclosed in U.S. Pat. No. 6,869,285, (hereinafter "'285 patent").

Much of the firearms simulator market uses a device known as a "Dvorak Kit." The Dvorak Kit may include a recoil simulator like the one disclosed in the '285 patent. Most kits that are being used include an inertial measurement unit ("IMU") in order to record the motions of the weapon for training purposes.

It can be difficult to conceal all the electronics needed to convert a weapon into a weapon that can be used in a weapons simulator for training purposes. Moreover, in many cases, it is desirable that the weapon, in most cases a firearm, remain mostly unmodified. To this end, it would be desirable to construct an apparatus that can be used to retrofit a weapon, in particular a firearm, with minimal modifications while still providing as much data as possible to a weapons training system. With such a system, a live weapon could be used in weapon simulators and for training the weapon owner.

When it comes to weapons training and weapon simulators, one of the most important data points to obtain, is the shot firing event. Accurately detecting the shot firing event allows the trainee's aim-point to be measured timely and precisely and hit point to be calculated. This can be difficult because the firearm aim-point is always moving. It may also allow the system to detect the movement of the firearm, before, during and after firing. This data can be analyzed and used to provide valuable feedback to the shooter regarding shooting errors and/or corrective actions, many of which happen just before, during or just after the shot firing event.

Numerous shot firing event detection devices exist in the market. Several solutions center around a laser emitter and electronic trigger that is packaged as an insert that fits within the chamber or bore of the barrel of a firearm. These offerings use a switch or similar hardware that senses the impulse delivered by a firing pin, imparted by hammer or striker (depending on the configuration of the firearm). Following the delivery of this impulse, the firing pin is the only moving part within the firearm. These systems are very accurate at detecting the shot firing event. In some cases, the switch is mounted to a valve. The impact on the switch is further transmitted through to the pneumatic valve that actuates a simulated recoil.

Other systems for detecting a trigger pull are rail mounted devices that are not in contact with the moving internal components. These devices may also pulse a laser but require recording of the shot firing event with an inertial sensor in the rail mounted device. The motion of the whole firearm from the recoil is used to register that the gun has fired. Because the system is waiting on the recoil to detect the firing, the system does not accurately detect the aim-point because the aim-point has been greatly disturbed by the recoil. By the time the laser pulse is fired and measured by a camera system, the weapon has moved substantially from the true aim-point. The resulting inaccuracy is an accepted practice of the industry.

To this end, it would be beneficial to have a way to detect the occurrence of a shot firing event more accurately and with minimal modification to the existing weapon. It would also be beneficial to have a way to detect a shot firing event that is adaptable to existing weapon systems and existing weapon simulations systems including recoil systems and the like.

SUMMARY OF THE EMBODIMENTS

Objects of the present patent document are to provide improved methods of detecting a shot firing event of a firearm or weapon during weapons training. Another object of the present patent document is to provide a method and apparatus for detection of a shot firing event that eliminates or at least ameliorates some of the problems known in the art. To this end, a method of determining an aim point of a firearm or simulated firearm at a time of firing is provided.

In some preferred methods, a laser bore sighted with a barrel of the firearm or simulated firearm is continuously pulsed. The laser is preferably pulsed at a frequency of 1 Hz or greater. In more preferred embodiments, the laser is pulsed at 10 Hz or 20 Hz or greater. In yet other embodiments, the laser may be pulsed even faster such as 50 Hz, 100 Hz or even faster. In most embodiments, the laser is mounted to the firearm or simulated firearm because it is difficult to boresight the laser in any other way.

The laser pulse location from the pulsing laser is continuously detected on a target. In preferred embodiments, this is achieved with one or more cameras designed to detect the pulse.

A shot firing event is detected. The shot firing event may be detected by a sensor mounted on the firearm or simulated firearm. The sensor may be any type of sensor that is capable of detecting a shot firing event. For example, an accelerometer may be used or an ultrasonic sensor as taught herein.

Once the shot firing event is detected, the aim point of the firearm or simulated firearm at the time of firing is extrapolated from the last detected laser pulse location and at least one other laser pulse location prior to the last laser pulse location. In preferred embodiments, a plurality of points prior to the last laser pulse location before firing are used to extrapolate the aim point at the time of firing.

In some embodiments, at least one laser pulse location on the target after the shot firing event may also be used to determine the aim point at the time of firing. In some embodiments, a plurality of laser pulse locations on the target after the shot firing event are used to determine the aim point. In most embodiments that factor in laser pulse locations on the target from after the shot firing event, the locations after the shot firing event are given less weight or less importance than the location prior to the shot firing event.

In preferred embodiments, the system is designed for use in a training facility where more than one firearm is being used at a time. In such embodiments, each weapon may have a laser mounted to it and all the lasers may be pulsed in a sequence so that only one laser is illuminated on the target at a time. Preferably, the pulsing laser is synchronized with the shutter of the camera so that pulses from the lasers illuminate the target when the shutter of the detection cameras is open. To this end, the frequency the laser is pulsed at is preferably divisible without remainder into a frame rate of a detection camera that is continuously detecting the laser pulse location from the laser on the target. Accordingly, the faster the frame rate of the camera, the faster the lasers can be pulsed. In a preferred embodiment, the frame rate of the camera is 60 Hz.

In some embodiments, the device used to detect the trigger pull event is an ultrasonic sensor. In such embodiments, a device for detecting the shot firing event of a firearm with an ultrasonic sensor is provided. In preferred embodiments, the device comprises: a housing including a rail interface in an outside of the housing wherein the rail interface is designed to attach to a rail of the firearm; a laser emitter mounted inside the housing; an IMU mounted inside the housing; an ultrasonic sensor located inside the housing and in direct contact with an inside wall of the housing; and a microcontroller in electrical communication with the ultrasonic sensor.

Although any type of firearm or weapon can be used in combination with the apparatus and methods disclosed, the system is typically used with a handgun or rifle.

The preferred ultrasonic sensor is an ultrasonic microphone however any type of ultrasonic sensor may be used. The ultrasonic sensor may be listening or sensitive to any frequencies above or around 20 kilohertz, the limit of human hearing. However, in preferred embodiments, the ultrasonic sensor listens or is sensitive to frequencies greater than or equal to 40 kilohertz.

In some embodiments, the apparatus may further include a pinger located in the firing chamber of the firearm. In order to allow the ultrasonic sensor to more easily distinguish the striking of the hammer, the pinger emits an ultrasonic signature when struck by the hammer of the firearm. This ultrasonic signature from the pinger is easily distinguished by the ultrasonic sensor from other noise in the frequency band.

In another aspect of the embodiments of the present patent document, a method of determining a weapon aim point at the time of firing is provided. In preferred embodiments, the method comprises: mounting an electronics module on the rail or other mounting feature of a weapon wherein the electronics module includes an ultrasonic sensor, an IMU and a laser emitter; continuously pulsing a laser beam from the laser; listening for a hammer strike with the ultrasonic sensor; transmitting a time of a hammer strike; calculating the weapon aim point by combining the time of firing with locational information from the laser beam.

In systems that use a continually pulsed laser beam, the simulation system is recording the weapon pointing position at all times. In this case, the speed of the firing event detection is less important. When the firing event is recorded, the simulation system looks backward in time at the history of recorded muzzle position to select the aim-point that corresponded to the delayed firing event that was recorded.

In systems without a continually pulsed laser and continuously recording of muzzle position, a fast shot event sensor that can quickly pulse the laser in reaction is critically important.

In some embodiments, the method further comprises transmitting orientation information from the IMU and using the orientation information in the calculating step.

In some embodiments, the method may also comprise transmitting an ultrasonic signature from a pinger wherein the pinger transmits when struck by a hammer of the firearm; and detecting an electronic signature from the pinger with the ultrasonic sensor. In some embodiments, the method records the shot event from an IMU/accelerometer located in rail mounted device on a continuous basis. In some systems the continuous bases could be at repeated intervals. In the systems that use this approach, the aim-point is determined by looking back into its recorded history a specified time interval. In some embodiments, the shot event recording method in the device can be used to detect shot events from live ammunition, or other combustion based cartridges.

The description above is just a summary of a few possible embodiments and a more detailed understanding may be obtained from the detailed description that follows along with reference to the drawings.

DETAILED DESCRIPTION OF THE PREFERRED EMBODIMENTS

Trying to detect the aim point of a weapon by pulsing a laser only after the shot firing event is detected by a camera system can still take a long time, depending on the camera. One possibility is to use a high frame rate camera (e.g. 300 Hz) to detect the laser pulse. This would mean that a shot could be recorded with a resolution of 3 milliseconds. Coupled with a fast ultrasonic system to detect the shot firing event, not much muzzle motion would occur and the system would be fairly accurate. In rifles, the laser pulse may even be recorded near the same time the bullet exits the muzzle. However, it is desirable to use slower, less expensive cameras.

Figure 1:
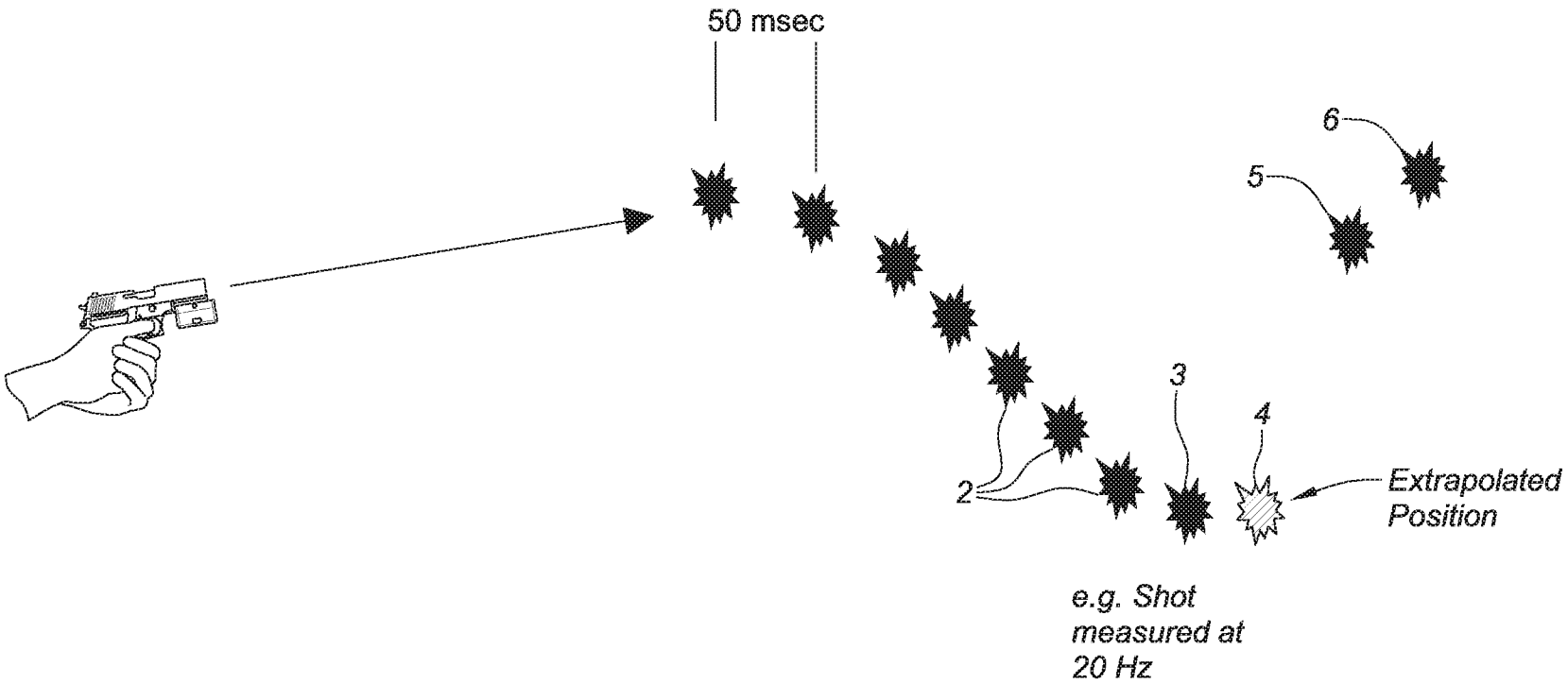
FIG. 1 illustrates a method of detecting the aim point of a firearm or weapon simulator by continuously pulsing a bore sighted laser.

FIG. 1 illustrates a method of detecting the aim point of a firearm or weapon simulator by continuously pulsing a laser coaxially aligned to the bore. Unlike in previous systems where the laser is only pulsed after a shot firing even is detected, the methods and systems of the present application pulse a laser continuously. The laser is preferably pulsed at a frequency of 1 Hz or greater. In more preferred embodiments, the laser is pulsed at 10 Hz or 20 Hz or greater. In yet other embodiments, the laser may be pulsed even faster such as 50 Hz, 100 Hz or even faster.

Although in preferred embodiments, the laser is actually contained within the bore of the barrel and is thus, coaxially aligned with the bore, in other embodiments the laser may be mounted to the firearm and aligned with the aiming location of the bore at a particular distance from the firearm such as with a boresight. Typical mounting locations for the laser are often on the top or bottom of the barrel and in many embodiments, the laser may be attached to a rail on the top or bottom of the barrel.

As may be seen in FIG. 1, the laser pulse location from each pulse of the pulsing laser is continuously detected on a target. This is illustrated in FIG. 1 by the dots labelled 2, 3, 5 and 6. Each of the points represents the recorded measurement of the aim point or muzzle location of the firearm at a particular time. In preferred embodiments, the detection of the laser pulses on the target is achieved with one or more cameras designed to detect the pulse. However, light sensors or any other type of sensor may be used to detect the laser pulses incident on the target. The cameras may be arrays, CCD cameras or any other type of camera.

A shot firing event is detected. The shot firing event may be detected by a sensor mounted on the firearm or simulated firearm. The sensor may be any type of sensor that is capable of detecting a shot firing event. For example, an accelerometer may be used or an ultrasonic sensor as taught herein. As may be seen in FIG. 1 by the difference between location 3 and location 5, after the shot is fired, a very large jump is detected. Typically, a shooter becomes still prior to an aimed shot. With recoil, the muzzle pointing location changes very quickly. However, as long as the accelerometer measured shot is recorded with a consistent delay, the muzzle position at the moment of the trigger pull can be extrapolated from the prior motion of the gun.

Once the shot firing event is detected, the aim point 4 of the firearm or simulated firearm at the time of firing is extrapolated from the last detected laser pulse location 3 and at least one other laser pulse location 2 prior to the last laser pulse location 3. In preferred embodiments, a plurality of points 2 prior to the last laser pulse location 3 before firing are used to extrapolate the aim point 4 at the time of firing.

The extrapolation method uses the time of the recorded shot from the motion sensor (or ultrasonic sensors) to scale the extrapolation distance past the last recorded aiming position prior to the shot. Numerous different interpolation/extrapolation methods may be used including linear extrapolation, polynomial, or others, just to name a few.

In preferred embodiments, the time of the shot firing event is detected and time stamped. If the detection mechanism is on the firearm, the time of the shot firing event and the fact that it occurred maybe transmitted to an external computer. This can be done through a wired or wireless link but is preferably done via a wireless link and preferably over a radio frequency "RF" link.

Simultaneous in and around the shot firing event, the location of the firearm aim-point is being recorded. This is typically done by a global shutter camera picking up the location of the pulsed laser on the firearm. The frame rate may be any frame rate but 60 Hz shutter with a fixed interval may be used. Obviously, the faster the shutter rate the more accurate but faster shutter rate cameras are more expensive. The methods taught herein allow more accurate calculations of aim-points while still using cameras with shutter speeds of 120 Hz or less; and more preferably 60 Hz or less; and even more preferably, 30 Hz or less.

Returning to FIG. 1, the camera records the X and Y positions of each laser pulse along with a time stamp for each position forming a set (t, x, y) for each laser pulse location. As may be seen in FIG. 1, a set (t, x, y) may be recorded for each laser pulse 2A, 2B, 2C, 3, 5 and 6. The time of the shot firing event, once moved as the same frame of reference as the recorded laser pulse positions, is compared with the "t" from each set of points to determine the last recorded position prior to the shot firing event. In the example of FIG. 1, position 3.

Once the timing of the shot firing event is established relative to the positions of the recorded laser pulses, a plurality of laser pulse positions prior to the shot firing event are identified for use in the extrapolation of the actual aim point at the time of firing. Depending on the embodiment, any number of laser pulse positions may be used. In some embodiments, 10 laser pulse positions are used. In other embodiments, 8, 5 or even 3 laser pulse positions may be used.

Once the laser pulse points to use in the extrapolation are identified, all the "x" components are used to extrapolate the x position of the aim point at the time of firing 4. Then all the "y" components are used to extrapolate the y position of the aim point at the time of firing 4. The "x" and "y" positions are extrapolated out to the "t" of the recorded shot firing event.

If the time stamp of the shot firing event is not in the same global time as the camera frames, both need to be put in the same timeframe. Either the time stamp converted to the camera time frame or vise versa or both converted to a third-time frame, such as a global time.

In some embodiments, the "t" of the aim-point at the time of the shot firing event 4, may be the actual recorded time stamp of the shot firing event transformed into the common reference frame if required. However, in some embodiments, a small delay can be subtracted from the actual "t" recorded as the shot firing event. The small delay is subtracted because, most systems will have some type of delay recording such an event and by subtracting out a small amount of time from the actual time recorded, a more accurate aim point can be calculated.

In some embodiments, if the time "t" of a laser pulse position is too close to the time of the shot firing event, that laser pulse position may be ignored even though it is prior to the shot firing event.

In some embodiments, at least one laser pulse location 5 on the target after the shot firing event may also be used to determine the aim point 4 at the time of firing. It may be beneficial to interpolate the laser pulse locations 5 after the shot firing event, albeit with weighting the after shot position very lightly in the calculation. In some embodiments, a plurality of laser pulse locations on the target after the shot firing event are used to determine the aim point. In most embodiments that factor in laser pulse locations on the target from after the shot firing event, the locations after the shot firing event are given less weight or less importance than the locations prior to the shot firing event.

There may be some added pipeline delay in sending the actual shot location into a simulation system due to the need to measure after the shot time. For example, even though frame 50 of the video is being displayed to the shooter, the system needs to use frame 49 to determine hit or miss. Most simulation systems are playing movies/graphics at 30 frames/second. Practically, the added 1 frame or 2 of delay is imperceptible to the user and does not affect training quality—as long as the calculation for hit or miss occurs in the appropriate frame.

The precision of this extrapolation in matching exact muzzle position can be difficult to measure. But, in testing with both live ammunition and simulated recoil systems, the trace extrapolation mechanism has shown accuracy improvements of several inches at a 5 meter firing distance. Depending on the exact use case, this greatly affects the ability to train: the more inaccurate a system is, the closer the targets have to be and the emphasis on marksmanship training is lessened.

In preferred embodiments, the system is designed for use in a training facility where more than one firearm is being used at a time. In such embodiments, each weapon may have a laser mounted to it and all the lasers may be pulsed in a sequence so that only one laser is illuminated on the target at a time. It is desirable to be able to track the multiple weapons shooting on the same screen and distinguish which one fired. A way to do this is to pulse the laser of the different weapons in sequence, continuously, such that each weapon lands 1 laser pulse in 1 frame of the camera acquisition.

Preferably, the pulsing laser(s) is/are synchronized with the shutter of the camera so that pulses from the lasers illuminate the target when the shutter of the detection cameras is open. To this end, the frequency the laser is pulsed at is preferably divisible without remainder into a frame rate of a detection camera that is continuously detecting the laser pulse location from the laser on the target. Accordingly, the faster the frame rate of the camera, the faster the lasers can be pulsed. In a preferred embodiment, the frame rate of the camera is 60 Hz As may be appreciated, for a system with a 60 Hz camera and 10 weapons, a muzzle position at 6 Hz maximum would be recorded. A system with only 2 weapons could record aiming locations at 30 Hz.

In the example of FIG. 1, a pistol is used with a bore sighted laser pulsing at 20 Hz, which produces a data point for muzzle pointing location every 50 msec. This type of resolution would be way too little time resolution if the laser wasn't continuously pulsed.

However, in the embodiments taught herein, using a common inexpensive accelerometer to detect the firing event may be sufficient when combined with a pulsed laser. The accelerometer can record the time that the recoil is experienced very precisely. The timestamp places the recoil in between two successive camera frames of the laser pulse recording.

Ultrasonic Trigger Pull Detection

In a live weapon, the recoil always lifts the muzzle upwards, due to the actual recoil imparted by the bullet mass exiting the gun. Unlike the systems described above that continuously pulse the laser, systems that rely on firearms motion to trigger the laser—in both live fire and simulation—will always have a sizeable inherent error.

An ultrasonic sensor can sense the detonation of the powder or hammer strike fall as sound propagated within the polymer/metal frame of the pistol—where speed of sound is much higher than air. This provides an advantage over inertial sensors in 10s of milliseconds to record the firing event.

In order to package a weapons simulator system without modification to the weapon, and in order to detect the shot firing event, the present patent document discloses a rail mounted module that uses ultrasound to detect the shot firing event from within the rail mounted module.

FIG. 1 illustrates a firearm 12 with a weapon simulator module 20 attached to the rail of the firearm 12. The firearm 12 and the weapon simulator module 20 make up a weapon simulator subsystem 10. The firearm 12 has a trigger 16. Although a firearm is shown in FIG. 1, the subsystem 10 could be constructed using any weapon. For example, a crossbow, rifle, compound bow, pistol, shotgun, machine-gun, or any other type of weapon could be substituted for the firearm 12. In particular, the weapon simulator module 20 is designed to be used with a weapon that includes a trigger 16. This is because the weapon simulator module 20 is specifically designed to detect a shot firing event.

Figure 2:
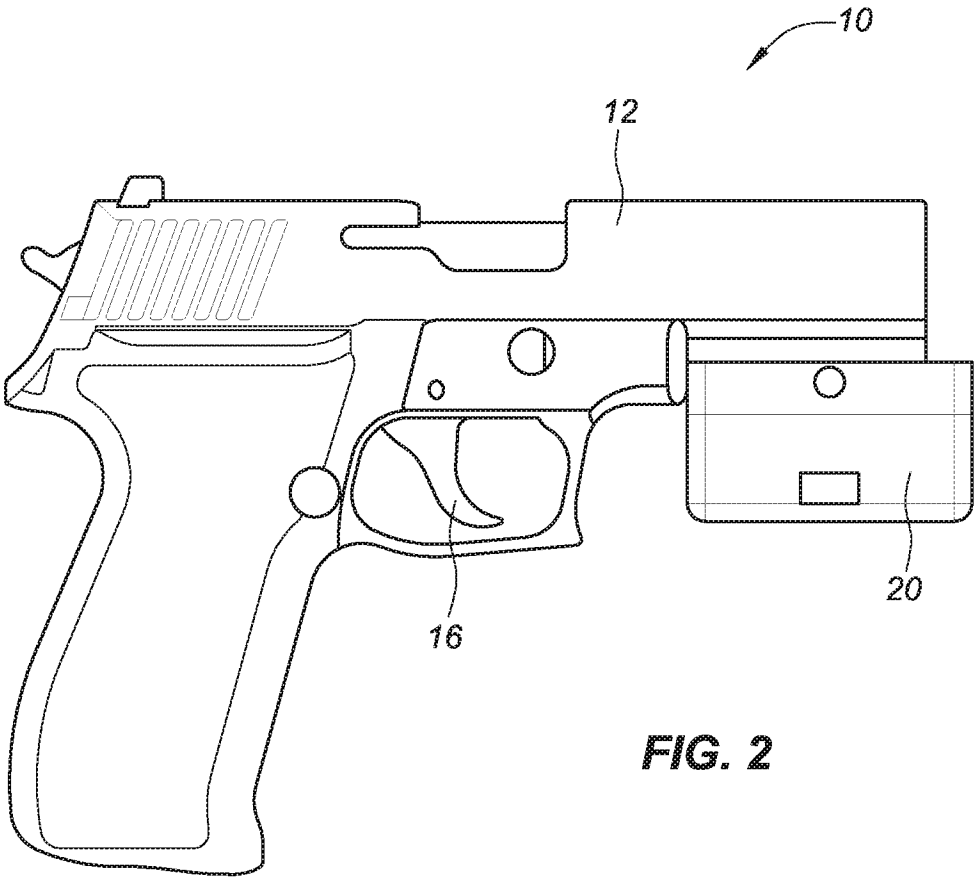
FIG. 2 illustrates a firearm with a weapon simulator module attached to the rail of the firearm.

FIG. 2 illustrates a weapon simulator module 20 mounted on a weapon rail 14. As may be seen, the weapon simulator module 20 includes a weapon rail interface 21 that interfaces and removably attaches the weapon simulator module 20 to the rail 14. It is well known in the art that accessories may be affixed to a weapon using a Rail interface system or RIS (a.k.a. Rail Accessory System or RAS). Common accessories include tactical lights, laser aiming modules, forward hand grips, telescopic sights and even bayonets. In order to make it easier to design such accessories, there are a number of standardized RIS including Weaver rail mount, Picatinny rail (MIL-STD-1913), NATO Accessory Rail, Keymod and M-LOK, to name a few. The interface 21 may use any one of these standard RIS interfaces or may use a proprietary interface.

Figure 3:
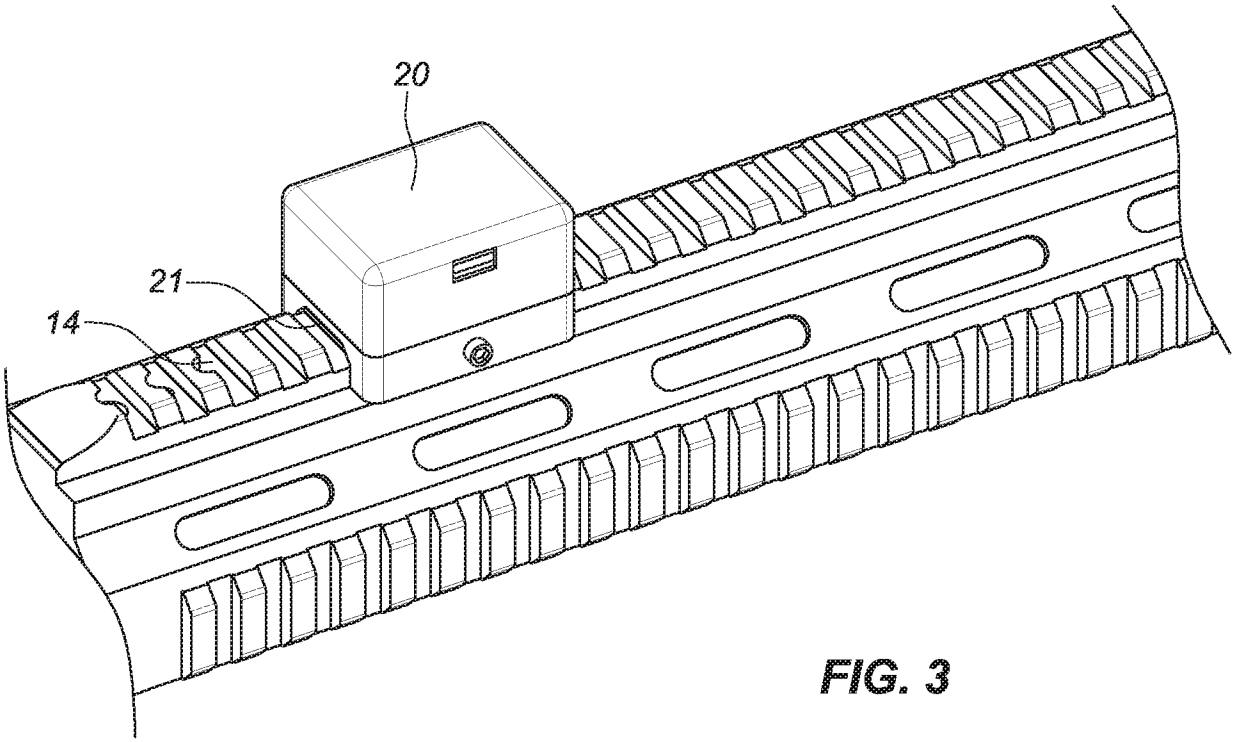
FIG. 3 illustrates a weapon simulator module mounted on a weapon rail.
Figure 4:
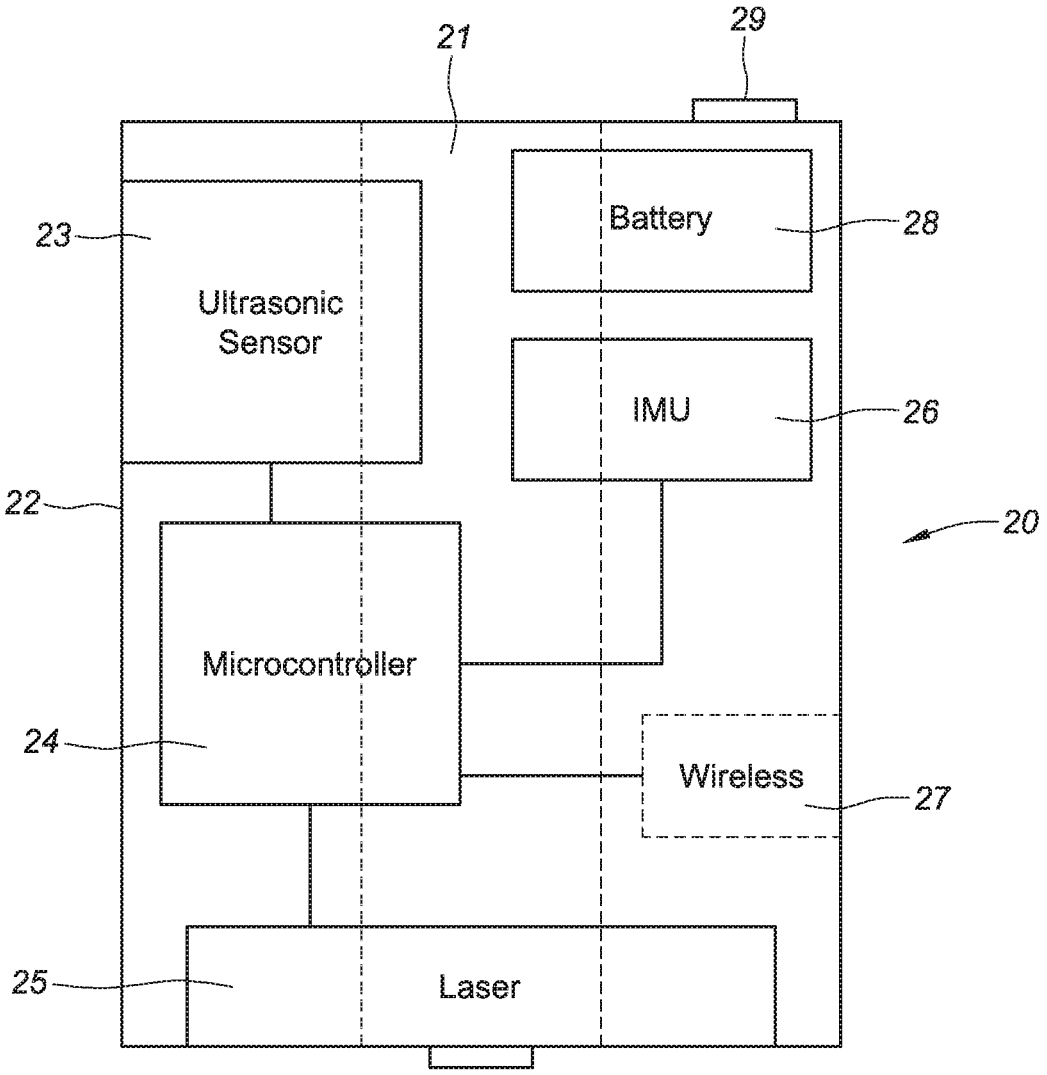
FIG. 4 illustrates an internal view of a weapon simulator module.

FIG. 3 illustrates an internal view of a weapon simulator module 20. As may be seen, the embodiment of FIG. 3 includes an ultrasonic sensor 23, inertial measurement unit (IMU) 26, microcontroller 24, and laser 25 all mounted in a housing 22. The housing includes a rail interface 21 (shown in dashed lines). The housing may be made of any material such as plastic, metal or ceramic. However, the housing is preferably made of metal such as steel, aluminum or titanium or some mix thereof and even more preferably the housing is made from stainless steel.

In operation, the microcontroller is the brains of the weapon simulator module 20 and receives input from the ultrasonic sensor and IMU and commands the laser. The weapon simulator module 20 may optionally include a wireless communication chip 27 that supports Bluetooth, IEEE 802.11 or another wireless protocol to allow communication of the weapon simulator module 20 with other devices or systems.

In some systems, the weapon simulator module 20 may optionally include a camera or cameras. The camera or cameras can give first person perspective of what the firearm is aiming at and such video can be helpful in diagnosing and training.

The weapon simulator module 20 may also include a battery 28 or battery pack 28 consisting of a plurality of batteries as is known in the art. The exterior of the case 22 may optionally include a charging port 29 such as a USB charging port to allow the unit 20 and in particular the battery 28 to be charged.

The ultrasonic sensor 23 is the key aspect to the invention. The ultrasonic sensor, which is typically an ultrasonic microphone, is design to monitor and detect a shot firing event. In a handgun, when the trigger is pulled, it activates the hammer. Firearms come in both single action (SA) and double action (DA) designs. In a single action firearm, the hammer must be cocked by hand and the trigger simply releases the hammer. In a double action design, the trigger both cocks the hammer and releases the hammer. Regardless of the design, firearms use triggers to initiate the firing of a cartridge in the firing chamber of the weapon. This is accomplished by actuating a striking device through a combination of spring and kinetic energy operating through a firing pin to strike and ignite the primer. There are two primary types of striking mechanisms, hammers and strikers. Hammers are spring-tensioned masses of metal that pivot on a pin when released and strike a firing pin to discharge a cartridge. Strikers are, essentially, spring-loaded firing pins that travel on an axis in-line with the cartridge eliminating the need for a separate hammer. In both cases a collision of either the hammer and the firing pin or the firing pin and the cartridge occur. This collision creates an acoustic signature. The acoustic sensor 23 is designed to detect this acoustic signature.

While extensive work has been conducted on the acoustic signatures of firearms, the research focuses on the muzzles blasts and shock waves of the supersonic bullets. The embodiments herein seek to detect an even earlier sequence, that of the hammer and firing pin. The ultrasonic sensor 23 is monitoring ultrasonic frequencies, typically greater than or equal to 40 KHz. The ultrasonic threshold and frequency band can be adjusted to sense the hammer strike on either an empty chamber or a live round. Ultrasound/Acoustic Emission can be superior to inertial sensors in their ability to discriminate between events like closing of an action or shooting of a live fire round.

As may be seen in FIG. 3, the ultrasonic sensor 23 is mounted in direct contact with the housing 22. In such an embodiment, the ultrasonic sensor 23 may be pressed into contact with the housing 22. The housing is then mounted to the weapon via the rail interface 21 and thus, pressed into contact with the body of the firearm itself. This puts the ultrasonic sensor in vibrational contact with the exterior of the firearm. Placing the ultrasonic sensor in direct contact with the housing 22 of the weapon simulator module 20, increases the sensitivity, or signal to noise ratio, of the system and allows the ultrasonic sensor to more easily detect a trigger pull.

In operation, the ultrasonic sensor 23 provides a signal to the microcontroller 24 and it is actually the microcontroller 24 that determines if the signal from the ultrasonic sensor 23 is actually a trigger pull. Once it has been determined that a trigger pull has occurred, the microcontroller 24 can instruct a signal to be sent to the simulator system that a trigger pull has occurred. As part of that notification, the weapon simulator module 20 may also send information about location and position from the IMU 26.

The weapon simulator system can then use the information from the weapon simulator module 20 to determine the position, orientation and aiming point of the firearm when the trigger was pulled. In preferred embodiments, the position and orientation of the firearm may be continuously buffered so that the information just before the trigger pull can also be retrieved and analyzed. In some embodiments, the weapon simulator system may also determine position and aiming of the weapon based on the position of the laser beam being omitted from the weapon simulator module 20. The weapon simulator module 20 may be mounted so laser emitter 25 aims coaxially with the barrel. The IMU 26 can be used to correct parallel errors from cant. The omitted laser can be detected and triangulated to determine the position of the weapon and aiming point. In preferred embodiments, the laser 25 is continuously pulsed from the weapon simulator module 20 so that the weapon simulator system can continuously keep track of the position and aiming point of the weapon.

In cases where the ultrasound from the hammer strike is difficult to discriminate against, a battery powered or piezoelectric ultrasound pinger with a switch can be placed into the chamber. In this case, when the hammer strikes, the pinger will be triggered to emit a unique tuned resonant ultrasonic tone. This tone will be clearly distinguishable from other naturally occurring acoustic emissions. This tone will transmit through the body of the weapon and be read by the ultrasonic microphone 23 that is located in the weapon simulator module 20.

Prior recoil designs disclose using a pilot metering valve for a mechanically actuated recoil system. While the current weapon simulator module 20 may be used in combination with prior recoil systems, it is also possible to use an electrically actuated recoil system that is installed in a weapon. This device may need to replace the barrel in a pistol, or part of the bolt carrier in an ArmaLite® ("AR") style weapon. The recoil device could also be ultrasonically controlled and would include a battery and a microcontroller. The microcontroller could be configured to open the valve either: 1.) On command from the weapon simulator module 20, which can emit its own communications tone to be read by the recoil system; or 2.) On its own listening and interpretation of the hammer strike acoustic emission signals.

In addition to actuating the recoil system, ultrasonic communications within the weapon could also enable other actuators such as magazine catches, magazine releases, sight motion, or other on-weapon simulation effects. The advantage of using ultrasonic communication is that all the on-weapon communication can be done wirelessly, thus making packaging easier, cleaner and allow less modification to the weapon.

Although the specification has explained the embodiments with reference to specific figures and examples, those descriptions are provided for example only and should not limit the full scope of the embodiments as claimed below.

What is claimed is:

1. A method of determining an aim point of a firearm or simulated firearm at a time of firing comprising:

continuously pulsing a laser at a frequency greater than 1 Hz wherein the laser is mounted to the firearm or simulated firearm and is coaxially aligned with a barrel of the firearm or simulated firearm;

continuously detecting a laser pulse location from the laser on a target;

detecting a shot firing event with a sensor mounted on the firearm or simulated firearm;

determining a last detected laser pulse location on the target prior to the shot firing event;

extrapolating the aim point of the firearm or simulated firearm at the time of firing from the last detected laser pulse location and a plurality of laser pulse locations prior to the last laser pulse location.

2. The method of claim 1, further comprising factoring into the extrapolating step at least one laser pulse location on the target after the shot firing event.

3. The method of claim 2, wherein the at least one location after the shot firing event is reduced in weight.

4. The method of claim 2, wherein a plurality of laser pulse locations on the target after the shot firing event are used.

5. The method of claim 1, wherein the sensor is an accelerometer.

6. The method of claim 1, wherein the sensor is an ultrasonic sensor.

7. The method of claim 1, wherein the frequency is greater than 10 Hz.

8. The method of claim 1, wherein the frequency is greater than 20 Hz.

9. The method of claim 1, wherein the frequency is divisible without remainder into a frame rate of a detection camera that is continuously detecting the laser pulse location from the laser on the target.

10. The method of claim 1, wherein the frequency and timing of the continuously pulsing laser is adjusted so that the laser pulse location from the laser on the target occurs when the shutter of a detection camera is open.

11. The method of claim 10, wherein multiple firearms or simulated firearms are each have a laser mounted to the firearm or simulated firearm that is bore sighted with a barrel of the firearm or simulated firearm and each laser is continuously pulsing in a repeated sequence so that each laser pulse location from a laser on a target occurs when the shutter of a detection camera is open.

12. The method of claim 10 or 11 wherein the frame rate of the detection camera is 60 Hz.

13. A method of determining an aim point of a firearm or simulated firearm at a time of firing comprising:

pulsing a laser at a frequency at 10 Hz or greater wherein the laser is bore sighted with a barrel of the firearm or simulated firearm;

detecting a laser pulse location from the laser on a target;

detecting a shot firing event;

determining a last detected laser pulse location on the target prior to the shot firing event;

extrapolating the aim point of the firearm or simulated firearm at the time of firing from the last detected laser pulse location and at least one laser pulse location prior to the last laser pulse location.

14. The method of claim 13, wherein the detecting step is performed by at least one camera observing a target.

15. The method of claim 13, further comprising factoring into the extrapolating step at least one laser pulse location after the shot firing event.

16. The method of claim 15, wherein the at least one location after the shot firing event is reduced in weight.

17. The method of claim 13, wherein the detecting step is performed by a sensor coupled to the firearm or simulated firearm.

18. The method of claim 17, wherein the sensor is selected from the group consisting of an ultrasonic sensor and an accelerometer.

19. The method of claim 14, wherein the pulsing laser is synchronized with a shutter of the camera so that the laser pulse location occurs when the shutter is open.

20. The method of claim 13, wherein multiple firearms or simulated firearms each have a laser bore sighted with a barrel of the firearm or simulated firearm and each laser is pulsing in a repeated sequence so that each laser pulse location from a laser on a target occurs when the shutter of a detection camera is open and only one laser pulse appears on the target at a time.

* * * * *